United States Patent [19]

Weischedel

[11] Patent Number: 4,690,114

[45] Date of Patent: Sep. 1, 1987

[54] SPEED GOVERNING SYSTEM FOR A FUEL INJECTED INTERNAL COMBUSTION ENGINE, ESPECIALLY A DIESEL ENGINE

[75] Inventor: Guido Weischedel, Stuttgart, Fed. Rep. of Germany

[73] Assignee: Robert Bosch GmbH, Stuttgart, Fed. Rep. of Germany

[21] Appl. No.: 940,225

[22] Filed: Dec. 8, 1986

Related U.S. Application Data

[63] Continuation of Ser. No. 741,182, Jun. 4, 1985, abandoned.

[30] Foreign Application Priority Data

Aug. 11, 1984 [DE] Fed. Rep. of Germany ..... 3429672

[51] Int. Cl.[4] ..... F02M 31/00

[52] U.S. Cl. ..... 123/357; 123/493

[58] Field of Search ..... 123/357, 358, 359, 179 L, 123/339, 493

[56] References Cited

U.S. PATENT DOCUMENTS

| | | | |
|---|---|---|---|
| 4,368,705 | 1/1985 | Stevenson | 123/358 |
| 4,425,888 | 1/1984 | Engel | 123/357 |
| 4,428,341 | 1/1984 | Hassler | 123/339 |
| 4,493,303 | 1/1985 | Thompson | 123/357 |
| 4,501,240 | 1/1985 | Adno | 123/358 |
| 4,506,641 | 3/1985 | Hasegawa | 123/339 |

*Primary Examiner*—Carl Stuart Miller

*Attorney, Agent, or Firm*—Frishauf, Holtz, Goodman & Woodward

[57] ABSTRACT

To provide for smooth operation of a fuel injected engine, typically a diesel engine, if the diesel engine is controlled to reduce speed and towards idling thereof, it is first determined if the actual speed (n) of the engine drops below a certain speed threshold (NS), the commanded speed (N), upon such sensed occurrence is evaluated and the time rate (1/K) of an exponential function of commanded rate of drop in engine speed is changed as a function of the decrease (dn/dt) of the actual speed of the engine. Engine temperature can be used to modify the speed threshold, and the rate of change can, additionally, be evaluated with respect to a predetermined rate of change of speed of the engine. A difference between commanded and actual speed, applied to a proportional-integral controller can be used with an offset which offset becomes effective only upon rise of engine speed after a prior drop. The system can be made sensitive to engine temperature and prevents bucking of the engine, particularly when cold, at which time a drop from a higher engine speed level to a lower speed level may occur at an excessive rate without touch control.

13 Claims, 4 Drawing Figures

SPEED GOVERNING SYSTEM FOR A FUEL INJECTED INTERNAL COMBUSTION ENGINE, ESPECIALLY A DIESEL ENGINE

This application is a continuation, of application Ser. No. 741,182, filed June 4, 1985 now abandoned.

Reference to related patent assigned to the assignee of present application, the disclosure of which is hereby incorporated by reference.

U.S. Pat. No. 4,425,888, Engel, et al.

The present invention relates to a speed control system and more particularly to a speed control or speed governing system for a fuel injected internal combustion engine, especially a diesel engine, in which an idle speed fuel controller which has proportional-integrating characteristic, is used.

BACKGROUND

The referenced U.S. Pat. No. 4,425,888, Engel, et al., assigned to the asignee of the present application describes a speed control or governing system for an automotive-type internal combustion engine, especially a self-ignited internal combustion engine, that is, for example of the diesel engine type. In accordance with the disclosure of the reference, the command value of speed is raised by a proportional-integrating acting controller when the actual speed has reached a predetermined relationship with respect to the command speed. In such a speed control system, commanded speed is changed when the difference between actual speed and commanded speed reaches a predetermined level or value. The difference between actual speed and commanded speed is maintained constant.

As the speed drops, particularly when the speed drops below a lower threshold level, a different control function becomes effective. The drop in commanded speed is then matched, at least roughly, to the actual speed drop, as determined by operating characteristics of the engine when it has normal operating temperature.

If the engine is cold, the actual speed drop may be more rapid than the speed drop when the engine is warm. Consequently, it is possible that the controller will not follow rapidly enough the actual changes in speed of the engine and a predetermined minimum idle speed may actually be passed, by the engine when it is still cold and the engine will stall. The control system, as described, while functioning well with an engine which is warm may not prevent stalling of the engine due to the excessively rapid speed drop when the engine is still cold.

THE INVENTION

A proportional integrating controller receives as an input the difference between an instantaneous commanded engine speed, for example, derived from a table, or engine characteristics, and the actual instantaneous engine speed; data representing commanded decrease in engine speed, in accordance with an exponential (e) function are provided. In accordance with a feature of the invention, the temporal course of drop of engine speed below a predetermined speed threshold NS is sensed and the level of the command speed is evaluated. If a drop in speed below the predetermined speed threshold NS, which is above idling speed, has been determined or sensed, the time rate of the exponential function of speed drop is then controlled to gradually, or more slowly approach idling speed of the engine. The rate of decrease of engine speed is thereby more accurately controlled and can take care of changes in engine operating characteristics, based on temperature of the engine.

In general, the invention relates to control of the speed drop towards idle speed of an internal combustion engine (ICE), typically a diesel engine. The temporal course of commanded speed drop, as well as drop of actual speed, will occur in accordance with a drop of an exponential function. The time constant of the exponential function is formed or controlled in dependence on operating parameters of the ICE.

The invention is not limited to a specific type of ICE, and several, or all operating parameters of the ICE can be used to influence, or determine the exponential function.

In accordance with a feature of the invention, the system carrying out the function can be derived to operate, as desired, in analog mode, or, with well known engineering changes, in digital mode.

The speed control or governing system in accordance with the invention has the advantage to provide for trouble free control of speed regardless of then pertaining engine operating characteristics, for example, engine temperature. Different types of engines will react differently to different temperature conditions of the engine. The system is adaptable to various types of engines and ensures, for all types of engines suitable operating speed under idling conditions, regardless of the then pertaining temperature or other operating conditions of the engine.

The course of drop of actual engine speed may be more rapid when the engine is cold than when it is warm. The control system becomes only effective when the actual engine speed drops below the predetermined threshold NS. In accordance with a feature of the invention, the rate of change of speed, that is, the rapidity of the drop itself is controlled not to fall below a minimum value. A slower drop of speed from, for example, an operating speed to idling speed thus can be commanded. The time constant of the exponential function of the commanded speed change will depend on the respectively measured speed drop of actual speed, and can be controlled or made proportional to a fixed factor which is set. The set point can be adjustable. The specific factor can be selected, or set with respect to the operating characteristics of a specific type of engine, and the speed relationships, or speed changes of the particular type of engine with respect to operating parameters, such as temperature for example. It is thus easily possible to construct a basic system and then match the particular system to a particular engine type, by merely changing the respective factor, which will involve, from a circuit point of view, for example, changing only the resistance value, or a resistance/capacity value in a circuit structure, which can be readily accomplished on integrated circuits (ICs) by a laser, or, otherwise by setting a potentiometer.

When the desired, that is, commanded idling speed is reached, control will become effective only when a predetermined speed offset, or speed difference is exceeded, and, thereafter, the actual speed again drops. Minor changes in speed which do not interfere with smooth running of the engine, even under idling conditions can be compensated for so that the speed control will not become effective due to minor oscillations or hunting and thus prevent uneven engine operation.

DRAWINGS

DETAILED DESCRIPTION

Figure 1:
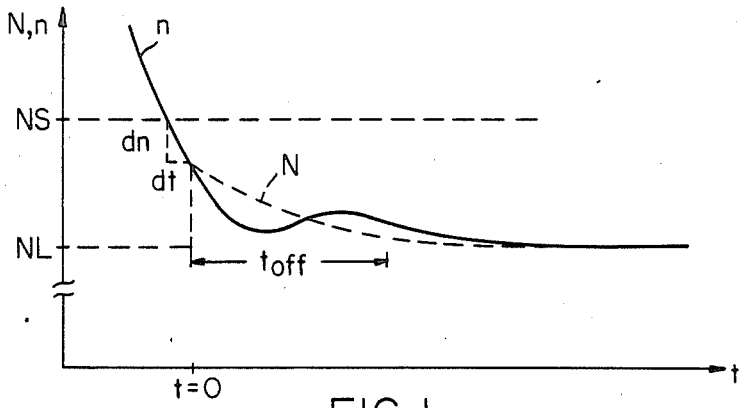
FIG. 1 is a speed-time diagram illustrating the actual speed-time relationship and commanded speed-time relationship as the actual speed drops, illustrated with respect to a cold diesel ICE.
Figure 2:
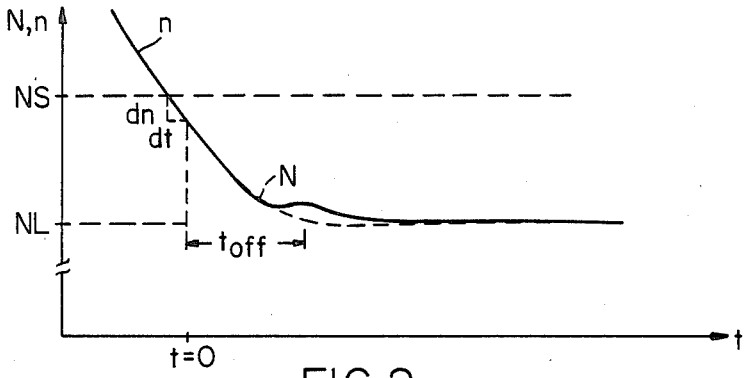
FIG. 2 illustrates the same characteristics as FIG. 1, but with the engine warm, that is, at normal operating temperature.
Figure 3:
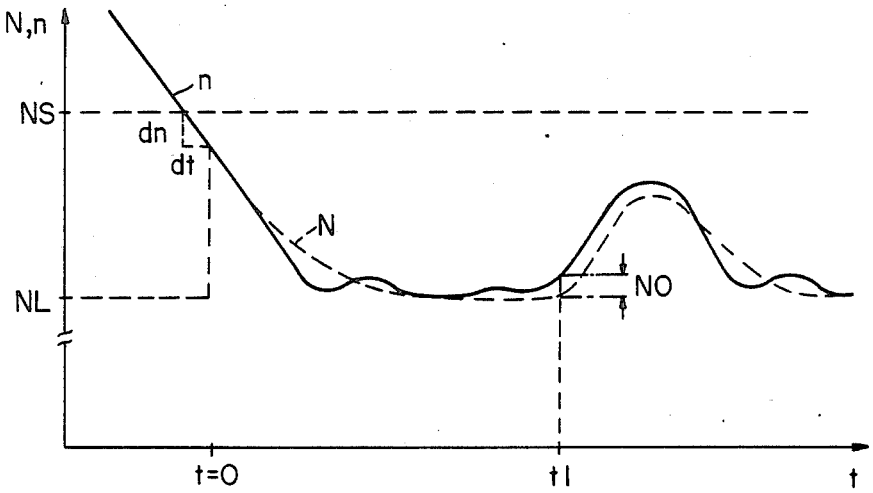
FIG. 3 is a diagram similar to FIG. 1 illustrating the characteristics of the engine, that is, actual speed and commanded speed with a following course of increase in commanded speed.

In the diagram of FIGS. 1 to 3, NS is a predetermined speed threshold; NL is an idle speed threshold or limit, which is a predetermined value; N the commanded speed and n the actual engine speed. The abscissa it represents a time axis.

The speed curve for actual speed, n, drops rapidly, as shown in FIG. 1, when, for example, the driver of the vehicle in which a diesel engine is installed lifts the foot off the accelerator pedal. The illustration of FIG. 1 shows engine speed when the engine is cold. As soon as the speed threshold level NS—determined, for example, by experimental or engine characteristics, has been passed, the control system becomes effective and determines the rate of change of actual engine speed, dn/dt. The rate of change of speed, that is, the change of speed per unit time is determined. When the rate of change of speed drops below a predetermined fixed minimum rate $n_{dmin}$ then, at time t=0, the commanded speed is raised so that the commanded speed N will drop with a shallow exponential function, which has a comparatively long time, $t_{off}$. The course or function of the commanded speed N will follow, without change, in accordance with this predetermined exponential, or e-function, the time constant of which is determined, essentially, by the a desired rate of drop in engine speed, which has previously been measured, that is, in accordance with a previously measured relationship dn/dt of the specific engine. Engine operating parameters, for example temperature can be used to influence or control the time constant. Change in the course of the commanded speed N will only become effective when the actual speed again begins to rise. The operation of the control system as speed rises will be described below in connection with FIG. 3.

After the engine has warmed, the characteristics of the rate of change of engine speed will be somewhat different. FIG. 2 illustrates the characteristics of actual speed n with the warm engine and it can be seen that the rate of actual drop in speed dn/dt is less than that in FIG. 1; the commanded speed N thus will have a shorter off time $t_{off}$, than in FIG. 1. These characteristics shown in FIG. 2 are a good example of the change in speed when the engine has reached normal operating temperature.

Both in FIGS. 1 and 2, the difference between predetermined idle speed fixed threshold NL and the threshold NS at which time NS the system becomes effective is the same. It may be desirable, however, to slightly raise the speed level of the idle speed threshold NL if the engine is still cold. The idle speed threshold NL with a cold engine, can be so increased that the engine will operate smoothly, and without bucking. Since, in a warm engine, increased idle speed is not necessary for normal smooth non-bucking engine operation, the idle speed can be droped to a lower level. This results in a decrease in engine noise, less exhaust gases, less stress on materials, and less use of fuel. In a typical automotive-type diesel engine, the predetermined idle speed NL at a cold ICE can be set for 1000 rpm, whereas, when the engine has reached normal operating temperature, the idle speed may be set for 600 rpm.

The command value for the idle speed NL can be changed in accordance with engine temperature simply by including a temperature signal derived from a temperature sensor in the control function; such a signal can be applied to a computer or otherwise standard engine control system which then computes the required engine idling speed based on engine temperature, for example, by addressing a previously determined table, for example, stored in a read-only memory (ROM) and then, based on temperature, applies the respective corresponding value to the control system. The speed threshold NS at which the system becomes effective remains at the predetermined value (see FIGS. 1, 2).

FIG. 3 illustrates the two characteristics for actual speed n and commanded speed N, if, after the ICE reached idling speed, i.e., at time $t_1$ an increase in speed is controlled, for example, by the operator. This increase in speed may be caused by depression of the accelerator pedal in an automotive engine. The commanded speed N in the controller follows the actual speed n but only when the actual speed n has exceed a speed offset value NO. The following conditions, thus, must be met:

$$n \uparrow \text{(rising) and } n-N>NO$$

The following of the commande speed N thus will occur only—with rising actual speed—when the difference between the actual speed n and the commanded speed N is greater than the previously determined, for example, predetermined speed difference or speed offset NO.

Upon subsequent drop of actual n the commanded speed N will again drop in accordance with an exponential function, the time constant of which corresponds to the time constant which was previously determined at the prior drop below the threshold level NS. Thus, the commanded speed N will be governed by the following relationship:

$$N=NL+(NS-NL)e(-t/K)$$

wherein $$K=dn/dt\cdot KV+KO$$

In the foregoing, N again is commanded speed, NL the idle speed threshold, NS the predetermined response speed threshold, dn/dt the rate of actual speed drop at the time the threshold NS is passed; t is the engine operating temperature; KV is the amplification factor of the control amplifier of controller R, and KO is the offset constant, which determines the speed offset NO (FIG. 3).

Figure 4:
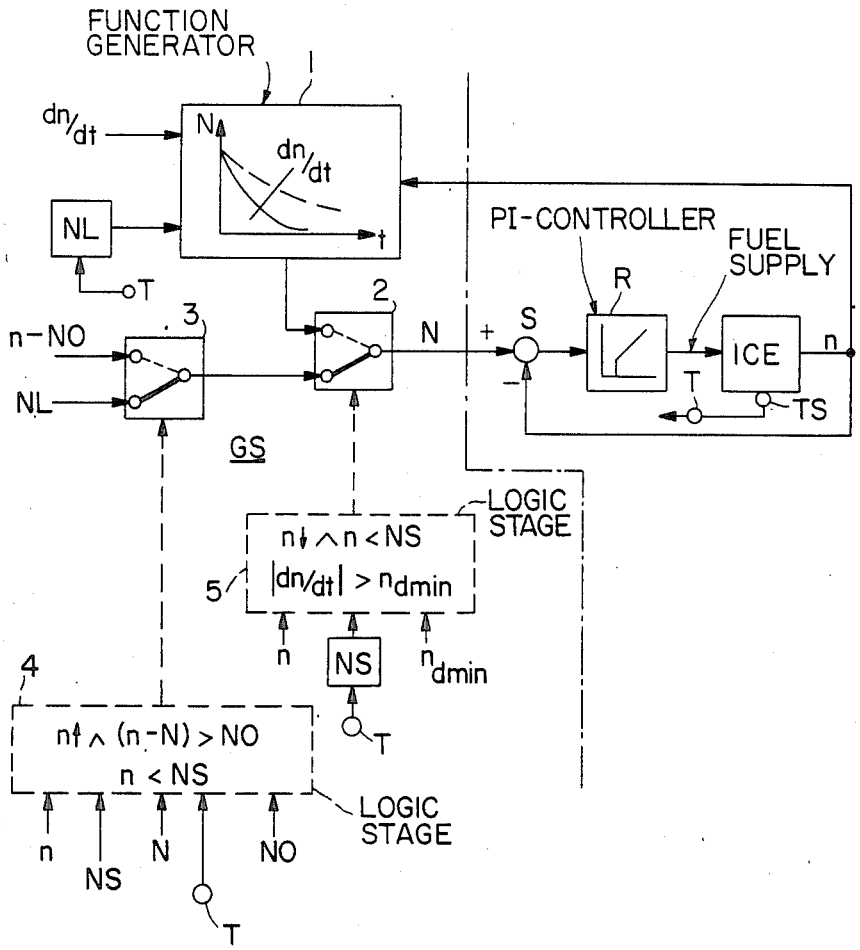
FIG. 4 is a general schematic block circuit diagram illustrating a system suitable for carrying out the control functions in accordance with the invention.

A system to carry out the control method in accordance with the present invention is shown in FIG. 4, to which reference will be made; FIG. 4 illustrates only the necessary elements, in block circuit configuration, to carry out the method of control. The diagram is schematic and represents a suitable circuit in analog form; it is, equally possible, to carryout all of the control functions described in analog form with reference to FIG. 4 by a suitably programmed digital computer or controller, as well known in digital control technology. The various functions can be obtained or realized by software. For example, temperature sensing can be carried out either by a temperature sensor providing an analog output signal, or by interrogating output levels derived from an engine temperature sensor and comparing the level with tables storing, at respective addresses, signals representative of temperature levels which, then, can command further control functions, based on the level derived from the sensor.

Essentially, this control system of FIG. 4 has a command value generator GS, a proportional-integrating controller R, and an ICE, which receives the output signals from the proportional-integral (PI) controller R. The PI controller R, at its input, received the difference between commanded speed N and actual speed n of the ICE.

The actual speed n of the ICE is applied to a function generator 1 which, in dependence on the rate of change of speed dn/dt, and in dependence on the desired or commanded idle speed threshold NL determines the course or rate of change for the commanded drop in speed, that is, the commanded speed curve N. The function generator 1 only becomes effective when the actual speed n passes the predetermined speed threshold level NS. The rate of change, that is, the rate of speed drop must exceed a predetermined minimum speed change $n_{dmin}$.

A first transfer switch 2 is coupled to the output of the function generator 1 which, if the foregoing conditions all pertain, will change over from the position shown into the broken line position, so that, then, the output of the function generator 1 will be coupled to one input terminal of a difference forming or subtraction circuit S.

For the time that the actual speed n is above the threshold NS, transfer switch 2 is as shown in the full line position; likewise, a second transfer switch 3 will be in the full line position as shown. The transfer switch 3 is changed over based on control from a control element 4 into broken line position which determines if the condition is fulfilled:

$$n\uparrow \quad (n-N)>NO$$

The condition for changeover of the first transfer switch 2 from full line to broken line position is determined by the logic element 5 which determines the following condition:

$$n\downarrow \quad n<NS$$

Temperature of the ICE is sensed by a temperature sensor TS, which provides a temperature output signal, schematically shown at terminal T to control, for example, the level of the thresholds NL and/or NS. Since the logic conjunction as determined by the logic circuits 4,5 may depend on the then pertaining temperature, and since temperature may affect the levels NS, the temperature signal, or a representation thereof, for example in digital form, is preferably applied to the logic circuits 4,5 as well. The actual construction of the logic circuits is well known and can be done in accordance with any suitable engineering practice, for example, in digital or analog form. The temperature signal at terminal T can also control the time constant of the exponential function controlling engine speed decrease.

Various changes and modifications may be made within the scope of the inventive concept.

What is claimed:

1. A method of controlling the operation of a fuel injected internal combustion engine (ICE), especially a diesel engine, upon commanding decrease of engine speed in a direction towards a predetermined idling speed (NL), utilizing an idle speed controller (R) which has proportional-integrating characteristics, said method comprising establishing a predetermined speed threshold (NS) which is above the predetermined idling speed (NL);

supplying an input signal to the controller (R) representative of the actual instantaneous speed of the engine (n);

supplying an input signal to the controller (R) representative of a commanded instantaneous engine speed (N) of the engine;

determining when the actual speed (n) of the engine drops below said predetermined speed threshold (NS), and generating a control signal;

and controlling the commanded rate of change of speed of the engine upon sensing that the actual speed (n) of the engine has dropped below said predetermined speed threshold (NS) towards said predetermined and lesser idling speed (NL) of the engine in accordance with an exponential function (e), wherein the exponential function determining the rate of change of speed is defined as follows:

$$N=NL+(NS-NL)e^{(-t/K)}$$

wherein $$K=dn/dt\cdot KV+KO$$

and wherein dn/dt is time rate of change of actual engine speed and wherein

KV is a constant

KO is a constant t represents time

NL represents the predetermined idle speed;

NS the predetermined speed threshold; and dn/dt the actual rate of drop in engine speed.

2. The method of claim 1 including the step of determining, if the actual rate of decrease (dn/dt) of engine speed falls below a predetermined fixed minimum rate ($n_{d\ min}$);

and wherein said step of controlling the commanded rate of change ($d_{n/dt}$) of the actual engine speed towards the predetermined idling speed is carried out only if the rate of change of actual engine speed (dn/dt) exceeds said predetermined fixed minimum rate.

3. The method of claim 1 including the step of setting the constant KV as a determinable adjustable amplification factor of an amplifier.

4. The method of claim 1 including the step of sensing the temperature of the engine and deriving a temperature-representative signal (T);

and including the step of raising said predetermined speed threshold (NS) if the sensed temperature of the engine is below a normal design operating temperature thereof.

5. The method of claim 1 including the step of sensing the temperature of the engine and deriving a temperature-representative signal (T);

and raising said predetermined idling speed (NL) if the sensed temperature of the engine is below a normal design operating temperature thereof.

6. The method of claim 1 including the step of sensing the temperature of the engine and deriving a temperature-representative signal (T);

and raising both said predetermined speed threshold (NS) as well as the predetermined idling speed (NL) if the sensed temperature of the engine is below a normal design operating temperature thereof.

7. The method of claim 1 including the step of measuring the actual rate of change (dn/dt) of decrease in engine speed;

and utilizing the thus measured value in the relationship or factor K of claim 1.

8. The method of claim 1 including the steps of commanding an idle speed level at said predetermined idling speed (NL);

determining when the actual speed (n) of the engine has reached, at least approximately, the so commanded idling speed level (NL); and upon supply of fuel to the engine to increase engine speed, controlling the controller (R) by the difference between commanded engine speed and actual instantaneous engine speed in such a manner that the commanded engine speed (N) follows the actual engine speed (n) upon increase in actual engine speed only with a difference, or offset (NO) during a continued condition in which the actual engine speed (n) is below said predetermined speed threshold (NS).

9. The method of claim 8 including the step of further controlling the controller (R) by applying the difference thereto upon subsequent dropping of actual engine speed (n), and controlling said drop of engine speed in accordance with said exponential function set forth in claim 1.

10. The method of claim 1 wherein the constant KV is a controllable constant;

including the steps of determining an operating parameter of the engine;

and controlling the time constant (e) of the exponential function in dependence on the so determined operating parameter of the engine by controlling said time constant as a function of said operating parameter.

11. The method of claim 10 wherein said operating parameter of the engine which controls the time constant (e) of the exponential function comprises temperature of the engine.

12. The method of claim 1 wherein the controller (R) includes an amplifier of controllable amplification ratio;

and wherein said constant KV is the amplification factor of the control amplifier.

13. The method of claim 8 wherein the constant KO in the relationship of claim 1 is representative of engine speed difference or offset (NO) from commanded speed.

* * * * *